US007132906B2

(12) United States Patent
Podell

(10) Patent No.: US 7,132,906 B2
(45) Date of Patent: Nov. 7, 2006

(54) COUPLER HAVING AN UNCOUPLED SECTION

(75) Inventor: Allen F. Podell, Palo Alto, CA (US)

(73) Assignee: Werlatone, Inc., Brewster, NY (US)

( * ) Notice: Subject to any disclaimer, the term of this patent is extended or adjusted under 35 U.S.C. 154(b) by 191 days.

(21) Appl. No.: 10/607,189

(22) Filed: Jun. 25, 2003

(65) Prior Publication Data

US 2004/0263281 A1 Dec. 30, 2004

(51) Int. Cl.
*H01P 5/12* (2006.01)

(52) U.S. Cl. ..... 333/109; 333/112

(58) Field of Classification Search ..... 333/109, 333/138, 156, 160, 238, 246, 112, 115, 116, 333/161, 236

See application file for complete search history.

(56) References Cited

U.S. PATENT DOCUMENTS 3,345,585 A 10/1967 Hildebrand
3,516,024 A 6/1970 Lange
3,904,991 A 9/1975 Ishii et al.
3,967,220 A 6/1976 Tagashira et al.
3,999,150 A 12/1976 Caragliano et al.
4,158,184 A 6/1979 Kenyon
4,216,446 A 8/1980 Iwer
4,443,772 A * 4/1984 Schwarzmann ..... 333/28 R
4,482,873 A 11/1984 Nyhus
4,800,345 A 1/1989 Podell et al.
4,937,541 A 6/1990 Podell et al.
4,999,593 A * 3/1991 Anderson ..... 333/112
5,557,245 A 9/1996 Taketa et al.
5,563,558 A 10/1996 Mohwinkel et al.
5,576,671 A * 11/1996 Agar et al. ..... 333/128
5,634,208 A 5/1997 Nishikawa et al.
5,689,217 A 11/1997 Gu et al.
5,742,210 A 4/1998 Chaturvedi et al.
5,793,272 A 8/1998 Burghartz et al.
5,852,866 A 12/1998 Kuettner et al.
5,889,444 A 3/1999 Johnson et al.
5,926,076 A 7/1999 Johnson et al.
5,982,252 A 11/1999 Werlau
6,020,783 A 2/2000 Coppola
6,111,476 A * 8/2000 Williamson ..... 333/109
6,246,299 B1 6/2001 Werlau
6,342,681 B1 1/2002 Goldberger et al.
6,346,863 B1 2/2002 Sasaki et al.
6,407,647 B1 6/2002 Apel et al.
6,407,648 B1 6/2002 Johnson
6,483,397 B1 11/2002 Catoiu
6,515,556 B1 2/2003 Kato et al.
6,518,856 B1 2/2003 Casale et al.
6,522,222 B1 2/2003 Pchelnikov et al.
6,580,334 B1 6/2003 Simburger et al.

(Continued)

OTHER PUBLICATIONS

An, Hongming et. al, *IA 50:1 Bandwidth Cost-Effective Coupler with Sliced Coaxial Cable*, IEEE MTT-S Digest, pp. 789-792, Jun. 1996.

(Continued)

*Primary Examiner*—Don Le
(74) *Attorney, Agent, or Firm*—Kolisch Hartwell, P.C.

(57) ABSTRACT

A symmetrical or asymmetrical coupler includes first and second conductive lines formed as at least first and second coupled sections and a delay section between the first and second coupled sections. The coupler may include plural alternating delay sections and coupled sections. Delay sections may include delay loops formed in both lines. One line may be a mirror image of the other line.

25 Claims, 2 Drawing Sheets

U.S. PATENT DOCUMENTS

| | | | | |
|---|---|---|---|---|
| 6,642,809 | B1 | 11/2003 | Shin et al. | |
| 6,686,812 | B1 | 2/2004 | Gilbert et al. | |
| 6,747,525 | B1 | 6/2004 | Iida et al. | |
| 6,756,860 | B1 | 6/2004 | Shin | |
| 6,759,918 | B1 * | 7/2004 | du Toit et al. | 333/17.3 |
| 6,765,455 | B1 | 7/2004 | De Lillo et al. | |
| 6,771,141 | B1 | 8/2004 | Iida | |
| 6,806,558 | B1 | 10/2004 | Apel | |
| 6,806,789 | B1 | 10/2004 | Bawell et al. | |

OTHER PUBLICATIONS

Walker, J.L.B., *Analysis and Design of Kemp-Type 3 dB Quadrature Couplers*, IEEE Transactions on Microwave Theory and Techniques, vol. 38, No. 1, pp. 88-90, Jan. 1990.

Bickford, Joel D. et. al, *Ultra-Broadband High-Directivity Directional Coupler Design*, IEEE MTT-S Digest, pp. 595-598, 1988, no month.

Young, Leo, *The analytical equivalence of TEM-mode directional couplers and transmission-line stepped-impedance filters*, Proceedings IEEE, vol. 110, No. 2, pp. 275-281, Feb. 1963.

Levy, Ralph, *General Synthesis of Asymmetric Multi-Element Coupled-Transmission-Line Directional Couplers*,* IEEE Transactions on Microwave Theory and Techniques, vol. MTT-11, No. 4, pp. 226-237, Jul. 1963.

Monteath, G.D., *Coupled Transmission Lines as Symmetrical Directional Couplers*, Proc. IEE, vol. 102, Part B, No. 3, pp. 383-392, May 1955.

Oliver, Bernard M., *Directional Electromagnetic Couplers*, * Proc. IRE, vol. 42, No. 11, pp. 1686-1692, Nov. 1954.

Gerst, C.W., *11-7 Electrically Short 90° Couplers Utilizing Lumped Capacitors*, Syracuse University Research Corporation, pp. 58-62, year unknown, no month.

* cited by examiner

COUPLER HAVING AN UNCOUPLED SECTION

BACKGROUND OF THE INVENTION

The present invention relates to couplers, and in particular to couplers having coupled sections separated by a delay section.

A pair of conductive lines are coupled when they are spaced apart, but spaced closely enough together for energy flowing in one to be induced in the other. The amount of energy flowing between the lines is related to the dielectric medium the conductors are in and the spacing between the lines. Even though electromagnetic fields surrounding the lines are theoretically infinite, lines are often referred to as being closely or tightly coupled, loosely coupled, or uncoupled, based on the relative amount of coupling.

Couplers are electromagnetic devices formed to take advantage of coupled lines, and may have four ports, one for each end of two coupled lines. A main line has an input connected directly or indirectly to an input port. The other end is connected to the direct port. The other or auxiliary line extends between a coupled port and an isolated port. A coupler may be reversed, in which case the isolated port becomes the input port and the input port becomes the isolated port. Similarly, the coupled port and direct port have reversed designations.

Directional couplers are four-port networks that may be simultaneously impedance matched at all ports. Power may flow from one or the other input port to the pair of output ports, and if the output ports are properly terminated, the ports of the input pair are isolated. A hybrid is generally assumed to divide its output power equally between the two outputs, whereas a directional coupler, as a more general term, may have unequal outputs. Often, the coupler has very weak coupling to the coupled output, which minimizes the insertion loss from the input to the main output. One measure of the quality of a directional coupler is its directivity, the ratio of the desired coupled output to the isolated port output.

Adjacent parallel transmission lines couple both electrically and magnetically. The coupling is inherently proportional to frequency, and the directivity can be high if the magnetic and electric couplings are equal. Longer coupling regions increase the coupling between lines, until the vector sum of the incremental couplings no longer increases, and the coupling will decrease with increasing electrical length in a sinusoidal fashion. In many applications it is desired to have a constant coupling over a wide band. Symmetrical couplers exhibit inherently a 90-degree phase difference between the coupled output ports, whereas asymmetrical couplers have phase differences that approach zero-degrees or 180-degrees.

Unless ferrite or other high permeability materials are used, greater than octave bandwidths at higher frequencies are generally achieved through cascading couplers. In a uniform long coupler the coupling rolls off when the length exceeds one-quarter wavelength, and only an octave bandwidth is practical for +/−0.3 dB coupling ripple. If three equal length couplers are connected as one long coupler, with the two outer sections being equal in coupling and much weaker than the center coupling, a wideband design results. At low frequencies all three couplings add. At higher frequencies the three sections can combine to give reduced coupling at the center frequency, where each coupler is one-quarter wavelength. This design may be extended to many sections to obtain a very large bandwidth.

Two problems come from the cascaded coupler approach. One is that the coupler becomes very long and lossy, since its combined length is more than one-quarter wavelength long at the lowest band edge. Further, the coupling of the center section gets very tight, especially for 3 dB multi-octave couplers. A cascaded coupler of X:1 bandwidth is about X quarter wavelengths long at the high end of its range. As an alternative, the use of lumped, but generally higher loss, elements have been proposed.

An asymmetrical coupler with a continuously increasing coupling that abruptly terminates at the end of the coupled region will behave differently from a symmetrical coupler. Instead of a constant 90-degree phase difference between the output ports, close to zero or 180 degrees phase difference can be realized. If only the magnitude of the coupling is important, this coupler can be shorter than a symmetric coupler for a given bandwidth, perhaps two-thirds or three-fourths the length.

These couplers, other than lumped element versions, are designed using an analogy between stepped impedance couplers and transformers. As a result, the couplers are made in stepped sections that each have a length of one-fourth wavelength of a center design frequency, and are typically several sections long. The coupler sections may be combined into a smoothly varying coupler. This design theoretically raises the high frequency cutoff, but it does not reduce the length of the coupler.

BRIEF SUMMARY OF THE INVENTION

The present invention provides a coupler having reduced length and, depending on the design, with low loss. This may be provided by a coupler including first and second conductive lines forming at least first and second coupled sections and a delay section between the first and second coupled sections. Further embodiments of this structure may include additional alternating delay sections and coupled sections or coupled sections of unequal length. The delay sections may be formed of a delay loop in one or both lines. One line may be a mirror image of the other line. Further, the coupler may be designed to be symmetrical or asymmetrical.

A coupler unit, which includes a coupled section and an adjacent delay section, has an effective electrical length equal to the sum of the electrical lengths of the two lines in the coupled section and the lengths of the lines in the delay section. The electrical length is defined as the line length divided by the wavelength of an operating frequency. In the case of a coupler in which only one line has a delay loop, the delay section has a length that equals the length of the space between the coupled sections plus the length of the delay loop.

Each coupler unit is equivalent to a conventional quarter-wavelength coupler in which the sum of the line lengths making up the coupler unit is equal to one-half the wavelength of an operating frequency, such as the center frequency of a band of operating frequencies. It will be seen that this new coupler may have a very short electrical length, since the coupled section may be very short but tightly coupled and the delay section relatively long, but much shorter than one-half wavelength.

It will also be appreciated that particularly when the coupler of the invention is configured with a delay loop in only the auxiliary or second line, the main line has very low loss. The loss in the auxiliary line is greater due to the existence of the delay loop or loops.

DETAILED DESCRIPTION

Figure 1:
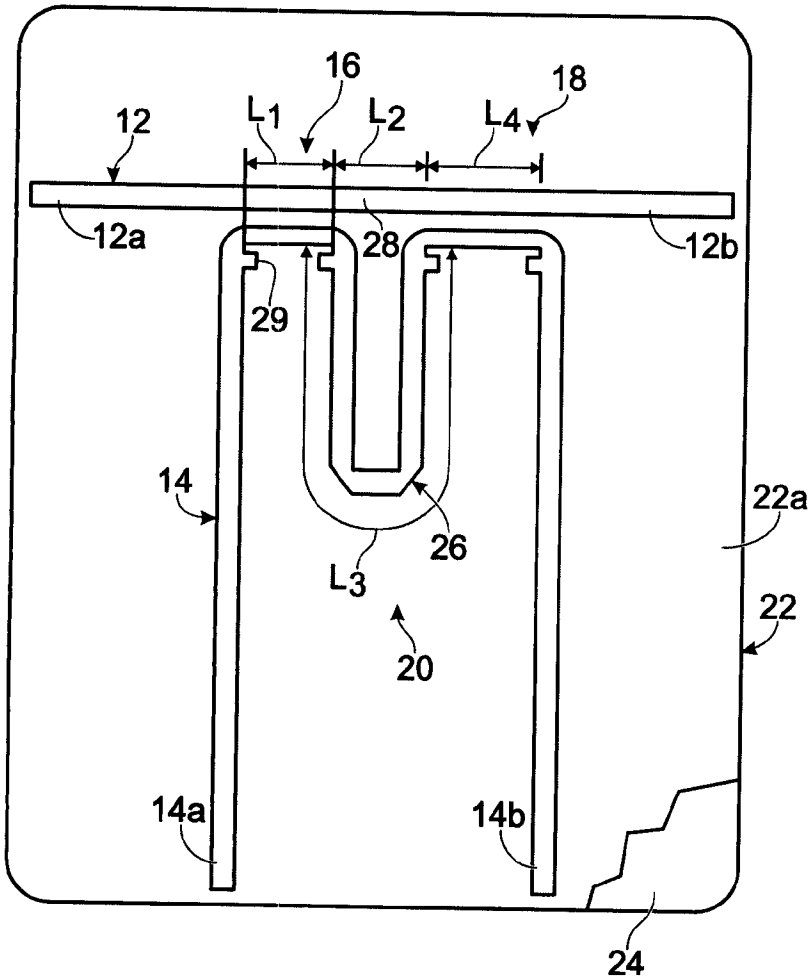
FIG. 1 is a top view of an embodiment of a simple asymmetrical directional coupler made according to the invention.

The invention generally provides a coupler that has an effective electrical length that is greater than the combined lengths of the coupled lines. It has been found that when two very short couplers are connected in series, the resulting coupling is the vector sum of the two individual couplings. When the two couplers are separated by a length of line, the electrical length of that line is added to the coupler length, and the frequency response corresponds to that of a long coupler. An example of such a coupler made according to the invention is illustrated in FIG. 1. The coupler, shown generally at 10, includes first and second conductive lines 12 and 14 formed into first and second spaced-apart coupled sections 16 and 18, and a delay section 20. Lines 12 and 14 may be formed as coplanar conductors on the face 22*a* of a dielectric substrate 22. In conventional microstrip structure, a ground plane 24 is formed on the back side of the substrate. Other structures, such as broadside-coupled lines, coplanar waveguides, slot lines, and coaxial lines, may also be used.

First conductive main line 12, in this example, is rectilinear, extending from an input end or port 12*a* and an output end or direct port 12*b*. Second conductive auxiliary line 14 has an end 14*a* functioning as a coupled port, and another end 14*b* functioning as the isolated port. It will be appreciated that the shape of the lines may be varied so long as there is coupling between the first and second lines in the first and second coupled sections.

Delay section 20 includes an open delay loop 26 formed in line 14, and a straight portion 28 in line 12 that spans the space between the coupled sections. The tabs at the base of the delay loop, such as tab 29, are capacitors that compensate for inductance produced in the transitions between coupled sections and delay loops. The primary function of the delay section is to increase the electrical length of the coupler without significant coupling with line 12, thereby allowing the overall length of the coupler to be made shorter than a conventional coupler. The lines may be considered coupled if they are spaced apart less than the distance between the lines and the ground plane. The electrical length of coupler 10 is the sum of twice the length $L_1$ of coupled section 16, plus the length $L_2$ of uncoupled portion 28 opposite from delay loop 26, plus the length $L_3$ of delay loop 26. This corresponds to the path of an input signal reflected back to coupled port 14*a* when the signal is reflected at the input end of coupled section 18. The coupling of the coupler is at a maximum when the two very short coupled sections 16 and 18 are separated by a delay section that is about one quarter wavelength (actually 50 electrical degrees) long, as represented by the length $L_2$ plus $L_3$. Beyond that the coupling decreases until it becomes zero when the delay section is one-half wavelength long. Ideally, to produce high coupling, length $L_2$ may be very short, the length of the delay loop may be about one quarter wavelength long, and coupled section 16 may be about one-eighth wavelength long.

Coupler 10 is an asymmetrical directional coupler, since coupled sections 16 and 18 have different lengths. In this example, coupled section 18 has a length $L_4$ that is longer than the length $L_1$ of coupled section 16. This coupler has high directivity, and a frequency response quite close to that of a single long coupler, however with a very short total line length on the main side, and a much greater line length on the coupled or auxiliary side. The loss through the coupler on the main side is nearly the theoretical minimum for that coupling level, while the loss on the coupled side is greater than the theoretical, due to the loss in the additional delay loop between the short-coupled sections. In many applications this is a very desirable trade-off. Because the main line 12 is very short in this embodiment, it has substantially less dissipative loss than the auxiliary line 14.

Figure 2:
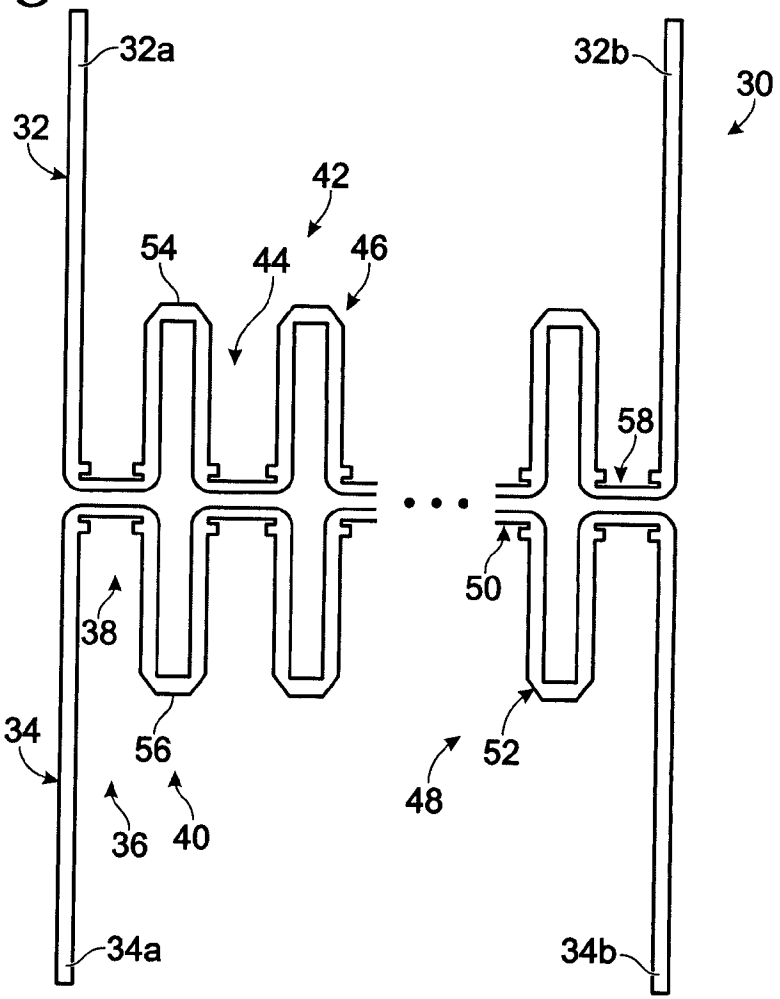
FIG. 2 is a top view of a quadrature hybrid, symmetrical directional coupler made according to the invention.

Coupler 10 may also be formed as a plurality of delay sections separated by coupled sections. An example is a coupler made according to a second embodiment of the invention, shown generally at 30 in FIG. 2. Coupler 30 represents a quadrature hybrid, symmetrical directional coupler with equal power split between a main line 32 and an auxiliary line 34. Main line 32 has corresponding ends 32*a* and 32*b* forming an input port and a direct port, respectively. Auxiliary line 34 has ends 34*a* and 34*b* that form a coupled port and an isolated port.

Coupler 30 includes N coupler units, with each coupler unit including a coupled section and a delay section, where N is an integer. A first coupler unit 36 includes a first coupled section 38 and a delay section 40. A second coupler unit 42 includes a second coupled section 44 and a delay section 46. An Nth coupler unit 48 includes an Nth coupled section 50 and a delay section 52. Each coupler unit may be considered a coupler with coupler 30 being a combination of these couplers.

Each delay section includes an uncoupled portion associated with each line, such as loops 54 and 56 of lines 32 and 34, respectively, of delay section 40. In this embodiment, the first and second lines share equally the length of the delay section. It will be appreciated that each coupler unit, except for the final one, includes the leading edge of the succeeding coupled section in order to provide for signal reflection at that point. Thus, there is an N+1 coupled section 58 associated with the final coupler unit 48. Stated alternatively, if there are N coupled sections, there are N−1 delay sections.

Coupler 30 is an example of a coupler in which the coupler units are identical, the coupled sections are equal in length and the delay loops are equal in length. As a result, coupler 30 is a quadrature hybrid, symmetrical directional coupler with equal power split between the direct port and the coupled port. This coupler, then, is equivalent to a coupler built entirely with uniformly coupled sections. All of the coupled sections may thus have about the same value of coupling. The length of the coupled sections may be adjusted to the desired coupling level for each equivalent portion of the coupler, and the delay loops may be adjusted in length to obtain the desired electrical length for each coupler section.

Alternatively, a coupler may have coupled sections, delay sections, delay spanning portions, and delay portions of different lengths. When two non-identical short couplers are combined with a delay line, the coupling is not zero at one-half wavelength between the couplers, but is essentially at a minimum. The frequency response of the coupler then is third order, even though it uses only two coupled sections.

Nearly two octaves of bandwidth can be achieved with this simple approach, still with very low main line loss.

For increased bandwidth in conventional directional couplers more sections can be added in cascade or in tandem. In these couplers, the main line and the coupled line are preferably identical. The present invention may be used to provide a multi-section asymmetrical cascade coupler that may cover a decade bandwidth with low main line loss. This coupler consists of a number of short tightly coupled sections connected together in series on the main side, and with delay lines of optimum length on the coupled side.

Figure 4:
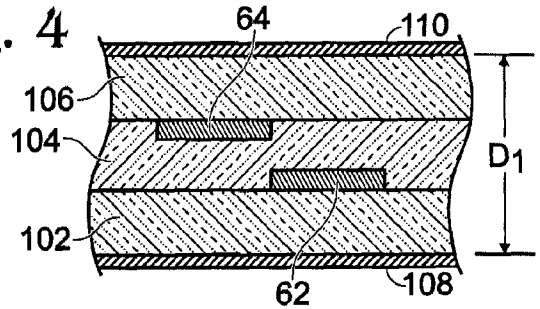
FIG. 4 is a cross-section taken along line 4—4 of FIG. 3.
Figure 3:
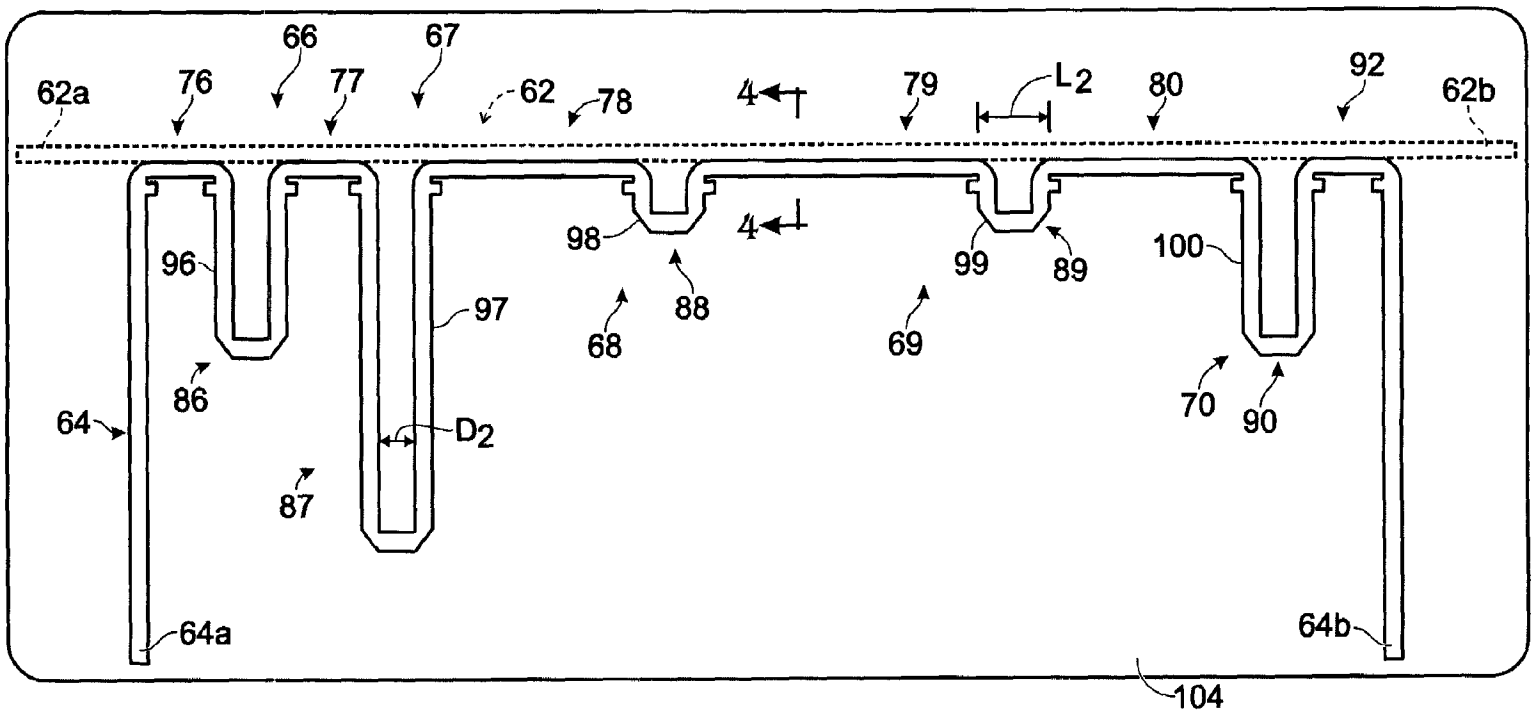
FIG. 3 is a top scale view of an embodiment of an asymmetrical directional coupler made according to the invention.

An example of such an asymmetrical directional coupler is shown generally at 60 in FIGS. 3 and 4. Coupler 60 includes a main line 62 having corresponding ends 62*a* and 62*b* forming an input port and a direct port, respectively. An auxiliary line 64 has ends 64*a* and 64*b* that form a coupled port and an isolated port, respectively. As shown, the main line follows a rectilinear path and the auxiliary line follows a varied serpentine path to one side of the main line.

More specifically, coupler 60 includes coupler units 66, 67, 68, 69 and 70 having respective coupled sections 76, 77, 78, 79 and 80 and delay sections 86, 87, 88, 89 and 90. A final coupled section 92 forms the sixth coupled section for the five coupler units, thereby providing a second coupled section for coupler unit 70. Delay sections 86, 87, 88, 89 and 90 include associated delay loops 96, 97, 98, 99 and 100.

As shown in the cross section of FIG. 4, coupler 60 is formed as a broadside coupled structure. Conductive lines 62 and 64 are sandwiched between dielectric layers 102, 104 and 106, which in turn are sandwiched between opposite ground plates 108 and 110. Line 62 is 100% offset from line 64 so that the two lines have only an edge in alignment between the ground plates. The ground plates are separated by a distance $D_1$. It has been found that coupling between opposite portions of a delay loop is not significant when the opposite portions are separated by a distance $D_2$ greater than or equal to distance $D_1$.

It is seen that the lengths of the delay loops and the coupled sections are different for different coupler units. An optimization program was used to determine the number of coupler units and the lengths of the coupled and delay sections for particular design criteria. Instead of varying the spacing between the lines to vary the cumulative coupling, the lengths of the coupled sections were varied. In one embodiment of coupler 60, the length $L_2$ is equal to 0.25 inches for an operating frequency of about 2 GHz, which frequency also corresponds to an upper limit frequency of an operating band of 200 MHz to 2 GHz. Over the operating band, this coupler has at least 20 dB directivity and between −18 dB and −20 dB coupling.

The overall length of coupler 60 is about five inches. One wavelength at the high-end frequency of 2 GHz is about 8 inches. A conventional 10:1 coupler would have about ten quarter-wavelength sections, which would correspond to a total equivalent length of about 20 inches. It is therefore seen that this invention provides a significant reduction in overall length.

It will also be apparent that the dissipative loss in the main line may be reduced as well. In the example just mentioned, the loss is less than 0.2 dB over the entire frequency band. This loss is about one third of the loss of a conventional design. For, high power couplers where the coupling levels are very low, say −40 dB, the power savings in this approach are substantial, particularly for wideband couplers whose main line electrical length at the highest frequency of use can be less than one quarter wavelength, as compared with the conventional coupler having a main line length of about 2 wavelengths.

Many design variations are possible. As has been shown, the number of coupler units may be varied, as well as the lengths of the coupled sections and delay sections. Further, the tightness of the coupling in each coupled section may be varied, if desired. As with conventional couplers, the direction of signal transmission may also be reversed. As a practical matter, the overall coupler may be reduced in length between the input and output ports by making the lines in the coupled sections tightly coupled. The amount of coupling provided by the coupler then is determined by the length of the coupled section and all coupled sections can have the same spacing between the main and auxiliary lines. This simplifies construction of the couplers. Also, the design of the delay loops may be varied and may include lumped elements.

While the present invention has been particularly shown and described with reference to the foregoing preferred embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring nor excluding two or more such elements.

The invention claimed is:

1. A coupler comprising:

first and second conductive lines having N coupled sections and N−1 uncoupled sections, at least the first section and the second section being of unequal length, where N is an integer greater than two, and each of the N−1 uncoupled sections is positioned between two coupled sections.

2. The coupler of claim 1 wherein at least two of the uncoupled sections have unequal lengths.

3. A coupler comprising:

first and second conductive lines having at least first and second coupled sections of unequal length, and an uncoupled section with delay loops of equal lengths formed in both lines between the first and second coupled sections.

4. A coupler comprising:

a first conductive line extending between first and second ports; and a second conductive line extending between third and fourth ports; the first and second conductive lines forming N coupled sections and N−1 uncoupled sections, where N is an integer greater than two, and each uncoupled section is positioned between two coupled sections.

5. The coupler of claim 4 wherein an uncoupled section includes an uncoupled loop formed in each of the first and second conductive lines.

6. The coupler of claim 5 wherein a portion of the first conductive line is a mirror image of a corresponding portion of the second conductive line.

7. The coupler of claim 4 wherein each of the uncoupled sections includes an uncoupled loop formed in each of the first and second conductive lines.

8. The coupler of claim 7 wherein the first conductive line is a mirror image of second conductive line.

9. The coupler of claim 8 wherein the coupler is a symmetrical coupler.

10. The coupler of claim 4 wherein adjacent coupled sections are spaced apart and an uncoupled section spans the space between the adjacent coupled sections, and the length of at least one of the uncoupled sections is about equal to one half of the wavelength of an operating frequency less the sum of twice the length of an adjacent coupled section.

11. The coupler of claim 4 wherein the first and second conductive lines are of unequal lengths in at least one uncoupled section.

12. The coupler of claim 11 wherein the first conductive line includes an uncoupled loop in the at least one uncoupled section.

13. The coupler of claim 12 wherein the second conductive line extends directly between the adjacent coupled sections in the at least one uncoupled section.

14. The coupler of claim 13 wherein the second conductive line extends directly between each of the N coupled sections.

15. The coupler of claim 14 wherein the N coupled sections extend in a line between a first coupled section and an Nth coupled section, and the second conductive line extends in a straight line between the first and Nth coupled sections.

16. The coupler of claim 4 wherein each of the coupled sections is less than one fourth of the wavelength of an operating frequency.

17. An asymmetrical directional coupler comprising:

first and second spaced-apart ground planes;

a substrate made of dielectric material mounted between the first and second ground planes;

a first conductive line mounted in the substrate between the first and second ground planes and extending between first and second ports; and a second conductive line mounted in the substrate between the first and second ground planes and spaced from the first conductive line, the second conductive line extending between third and fourth ports; the first and second lines forming N coupled sections and N−1 uncoupled sections, where N is an integer greater than one, with each uncoupled section positioned between two coupled sections, wherein the coupled sections are not all of equal length and the uncoupled sections are not all of equal length.

18. The coupler of claim 17 wherein the ground planes are a distance apart, and each uncoupled section forms an open loop having a spacing between opposite portions that is at least the distance between the ground planes.

19. The coupler of claim 17 wherein the first and second conductive lines are of unequal lengths in at least one uncoupled section.

20. The coupler of claim 19 wherein the first conductive line includes an uncoupled loop in the at least one uncoupled section.

21. The coupler of claim 20 wherein the second conductive line extends directly between the adjacent coupled sections in the at least one uncoupled section.

22. The coupler of claim 21 wherein the second conductive line extends directly between each of the N coupled sections.

23. The coupler of claim 22 wherein the N coupled sections extend in a line between a first coupled section and an Nth coupled section, and the second conductive line extends in a straight line between the first and Nth coupled sections.

24. A quadrature hybrid coupler comprising:

first and second conductive lines symmetrically forming spaced-apart coupled sections, and an uncoupled section spanning the space between adjacent coupled sections, each uncoupled section being formed of equal uncoupled loops in the first and second lines.

25. The coupler of claim 24, wherein the coupled sections are of equal length, and the length of each of the uncoupled sections is substantially equal to one half of the wavelength of an operating frequency less twice the length of an adjacent coupled section.

* * * * *